US010145070B2

(12) United States Patent
Reichert et al.

(10) Patent No.: US 10,145,070 B2
(45) Date of Patent: Dec. 4, 2018

(54) GANGWAY HAVING HYDRAULIC POSITION LOCKING ASSEMBLY

(71) Applicant: Safe Rack, LLC, Andrews, SC (US)

(72) Inventors: Jeff W. Reichert, Pawleys Island, SC (US); Jeffrey David Scott, Cornelius, NC (US)

(73) Assignee: Safe Rack LLC, Andrews, SC (US)

( * ) Notice: Subject to any disclaimer, the term of this patent is extended or adjusted under 35 U.S.C. 154(b) by 0 days.

(21) Appl. No.: 15/416,562

(22) Filed: Jan. 26, 2017

(65) Prior Publication Data

US 2017/0211246 A1 Jul. 27, 2017

Related U.S. Application Data

(60) Provisional application No. 62/287,187, filed on Jan. 26, 2016.

(51) Int. Cl.

| | |
|---|---|
| ***E01D 19/00*** | (2006.01) |
| ***E01D 15/02*** | (2006.01) |
| ***F15B 1/24*** | (2006.01) |
| ***F15B 13/01*** | (2006.01) |
| ***F15B 15/14*** | (2006.01) |
| ***F15B 15/20*** | (2006.01) |

(52) U.S. Cl.

CPC ..... *E01D 19/00* (2013.01); *E01D 15/02* (2013.01); *F15B 1/24* (2013.01); *F15B 13/01* (2013.01); *F15B 15/149* (2013.01); *F15B 15/202* (2013.01); *F15B 2201/31* (2013.01)

(58) Field of Classification Search

CPC . E01D 19/00; E01D 15/02; F15B 1/24; F15B 13/01; F15B 15/149; F15B 15/202; F15B 2201/31

USPC ..... 14/69.5–72.5

See application file for complete search history.

(56) References Cited

U.S. PATENT DOCUMENTS

| | | | | |
|---|---|---|---|---|
| 2,974,336 | A | 3/1961 | Kelley | |
| 3,705,610 | A * | 12/1972 | Baudras | B67D 7/002 137/615 |
| 7,950,095 | B2 * | 5/2011 | Honeycutt | B21D 5/00 14/69.5 |
| 8,387,191 | B2 * | 3/2013 | Honeycutt | B63B 27/14 114/362 |
| 8,479,884 | B2 | 7/2013 | Mizell et al. | |
| 8,745,799 | B1 * | 6/2014 | Thomasson | B65G 69/22 14/31 |
| 9,050,229 | B1 * | 6/2015 | Morris | A61G 3/061 |
| 9,567,759 | B2 * | 2/2017 | Mizell | B66F 11/04 |
| 2007/0101516 | A1 | 5/2007 | Carrigan | |

(Continued)

OTHER PUBLICATIONS

Non-final Office Action dated Sep. 13, 2017 in co-pending U.S. Appl. No. 15/217,320, all enclosed pages cited.

(Continued)

*Primary Examiner* — Raymond W Addie

(74) *Attorney, Agent, or Firm* — Nelson Mullins Riley & Scarborough, LLP

(57) ABSTRACT

A gangway comprising a fixed platform. A support structure is connected to the fixed platform in a manner that allows the support structure to rotate with respect to the fixed platform. A releasable position locking assembly that inhibits rotation of the support structure in a raising direction is also provided. The releasable locking assembly includes a closed-loop fluid arrangement.

20 Claims, 5 Drawing Sheets

(56) References Cited

U.S. PATENT DOCUMENTS

| | | | | |
|---|---|---|---|---|
| 2011/0047723 | A1* | 3/2011 | Fleischer | B63B 27/14<br>14/69.5 |
| 2012/0006619 | A1* | 1/2012 | DuBose | B60P 1/00<br>182/113 |
| 2013/0047352 | A1 | 2/2013 | Corfield | |
| 2017/0030034 | A1 | 2/2017 | Lawson et al. | |
| 2017/0146035 | A1* | 5/2017 | Afshari | F15L 311/10 |
| 2017/0340493 | A1* | 11/2017 | Sidhu | B60P 1/435<br>1/435 |

OTHER PUBLICATIONS

Response to non-final Office Action dated Sep. 13, 2017 in co-pending U.S. Appl. No. 15/217,320, filed Jan. 16, 2018, all enclosed pages cited.

Final Office Action dated Mar. 8, 2018 in co-pending U.S. Appl. No. 15/217,320, all enclosed pages cited.

Response to final Office Action dated Mar. 8, 2018 in co-pending U.S. Appl. No. 15/217,320, filed May 11, 2018, all enclosed pages cited.

* cited by examiner

GANGWAY HAVING HYDRAULIC POSITION LOCKING ASSEMBLY

PRIORITY CLAIM

This application is claims the benefit of U.S. provisional application Ser. No. 62/287,187, filed Jan. 26, 2016, which is incorporated herein by reference in its entirety.

FIELD OF THE INVENTION

The present invention relates to fall restraint equipment, and more particularly, to a gangway having a novel position locking assembly.

BACKGROUND OF THE INVENTION

Fall restraint equipment, such as gangways, may comprise platforms, ramps, bridges, steps, guardrails, and other support structures. Gangways may be used to provide access to an area, such as the top of a storage container. For example, a semi-trailer truck or a railroad carriage transporting dry goods may need to be unloaded from the container's top. A gangway is used to provide workers a path to unload the material.

SUMMARY OF THE INVENTION

The present invention recognizes and addresses the foregoing considerations, and others, of prior art construction and methods.

One aspect of the present invention provides a gangway comprising a fixed platform. A support structure is connected to the fixed platform in a manner that allows the support structure to rotate with respect to the fixed platform. A releasable position locking assembly that inhibits rotation of the support structure in a raising direction is also provided. The releasable locking assembly includes a closed-loop fluid arrangement.

In some preferred embodiments, the closed loop fluid arrangement comprises a cylinder in which a piston reciprocates. Fluid handling components including an unlock valve are also provided in this case. The fluid handling components are configured to allow transfer of fluid from a first side of the piston to a second side of the piston as the support structure is lowered into a working position. The fluid handling components do not allow transfer of fluid from the second side of the piston back to the first side for raising of the support structure unless the unlock valve is opened. For example, the cylinder and fluid handling components may be integrated into a cylinder unit connected between the support structure and a fixed attachment structure.

Preferably, the fluid handling components may further comprise a relief valve configured to allow transfer of fluid from the second side of the piston back to the first side when a predetermined threshold pressure is encountered. The relief valve may be adjustable so that the predetermined threshold pressure can be varied.

The fluid handling components may further comprise an accumulator for receiving excess fluid due to volume occupied by a piston rod of the piston. In such embodiments, the accumulator may comprise a free piston movable against a spring. A stop feature may be provided to limit axial movement of the free piston. For example, the spring may comprise a coil spring and the stop feature may be configured as a stop tube coaxial with the coil spring.

Preferably, the fluid handling components may include a check valve through which fluid transfers from the first side of the piston to the second side of the piston. Moreover, the unlock valve may comprise a manual pull valve.

According to another aspect, the present invention provides a gangway comprising a support structure having a proximal end and a distal end, the proximal end of the support structure being pivotally connected to a platform. A cage assembly is pivotally connected to the distal end of the support structure. In addition, a releasable position locking assembly inhibits rotation of the support structure in a raising direction. The releasable locking assembly includes a cylinder in which a piston reciprocates and fluid handling components. The fluid handling components include an unlock valve that when opened allows flow of fluid to a first side of the piston for raising of the support structure.

The accompanying drawings, which are incorporated in and constitute a part of this specification, illustrate one or more embodiments of the present invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
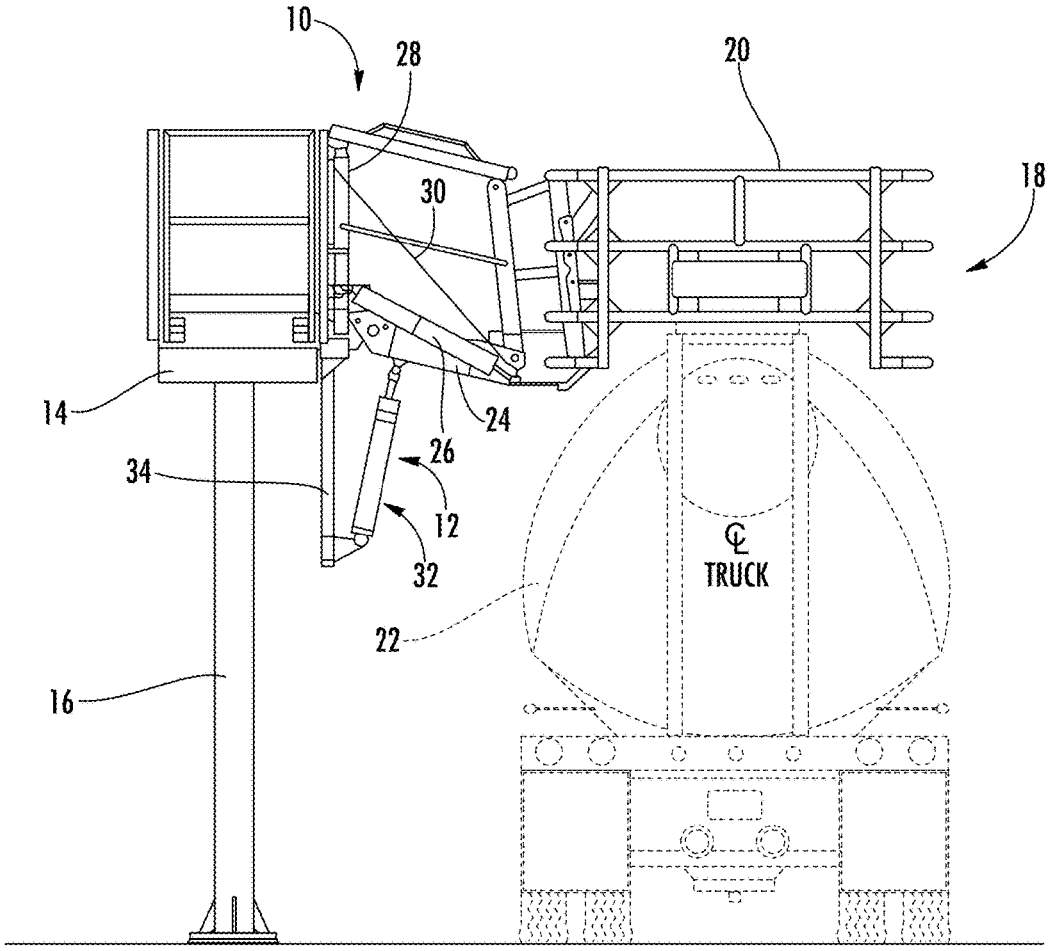
FIG. 1 is a side elevation of a platform equipped with a gangway having a position locking assembly in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Examples of gangways, their components, and associated fall restraint equipment are set forth in U.S. Pat. No. 7,950,095 (entitled "Gangway and Method for Manufacturing Same") and U.S. Pat. No. 8,387,191 (entitled "Gangway Bearing Retainer Plate"), both of which are incorporated fully herein by reference for all purposes.

FIG. 1 illustrates a gangway 10 including a position locking assembly 12 in accordance with the present invention. The proximal end of gangway 10 is pivotally connected in this case to a fixed platform 14 located at the appropriate height (twelve feet in this example). Platform 14 is supported at this height, such as by a support column 16. A cage assembly 18 is pivotally connected to the distal end of gangway 10. As shown, cage assembly 18 includes a rail structure 20 defining an enclosed area within which a worker can stand when cage assembly 18 is lowered into the working position. Typically, cage assembly 18 is lowered so as to be located around an access hatch of a storage container (such as trailer 22). Examples of suitable gangways that may be used with embodiments of the present invention are shown in U.S. Pat. No. 7,950,095.

Gangway 10 has a support structure 24 that pivots with respect to platform 14. A ramp (or a set of pivotal stairs) is carried by the support structure. Gangway 10 may be stowed when not use by rotating the support structure such that it oriented in an upward (i.e., generally vertical) position. In a preferred embodiment, counterbalanced springs (such as spring 26) are located between the distal end of support structure 24 and an associated upright (e.g., upright 28). These springs assist rotation of the support structure and ramp with respect to platform 14.

When gangway 10 is pivoting into the working position, chains (such as chain 30) may be locked with respect to an associated upright to prevent further lowering of the support structure. Such chains, however, do not prevent the user from slightly raising the support structure 24 against operational instructions. Because of the counterbalanced springs, support structure 24 will tend to remain in this slightly raised position unless it is then carrying additional weight (such as a person standing on it). In certain circumstances, the slightly raised support structure can yield undesirable results. However, position locking assembly 12 prevents upward movement of support structure 24 (and thus cage 18) unless the user affirmatively acts to bring support structure 24 to the stowed position.

In this embodiment, locking assembly 12 comprises a cylinder unit 32 pivotally connected on one end to the underside of support structure 24. The other end of cylinder unit 32 is pivotally connected in this case to an attachment structure 34 depending from platform 14. As will be explained more fully below, cylinder unit 32 contains hydraulic fluid that is readily displaced when gangway 10 is lowered. Once gangway 10 is in the lowered position, however, release of the hydraulic fluid is normally not allowed unless initiated by a worker not standing on the storage container. The incompressibility of the hydraulic fluid thus prevents raising of the platform at undesirable times.

Figure 2:
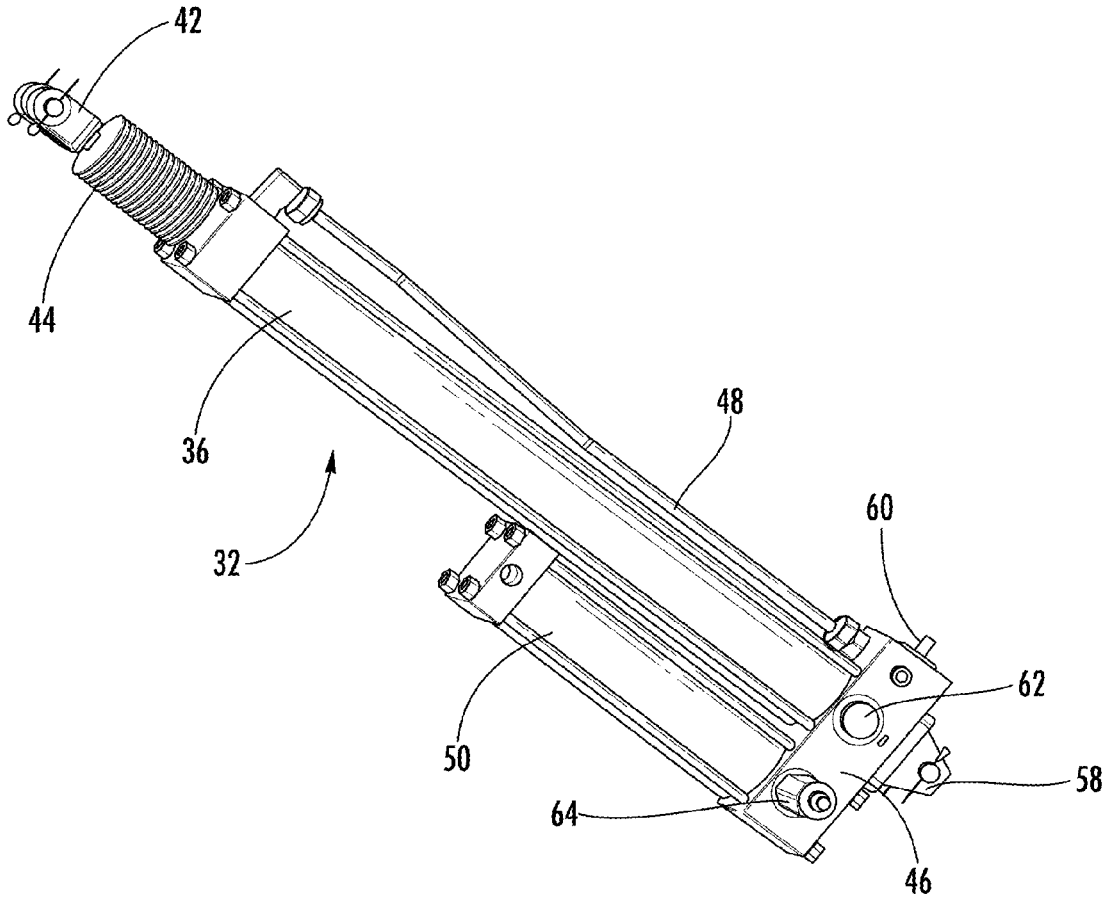
FIG. 2 is a perspective view of a cylinder unit of the position locking assembly of the embodiment of FIG. 1.
Figure 3:
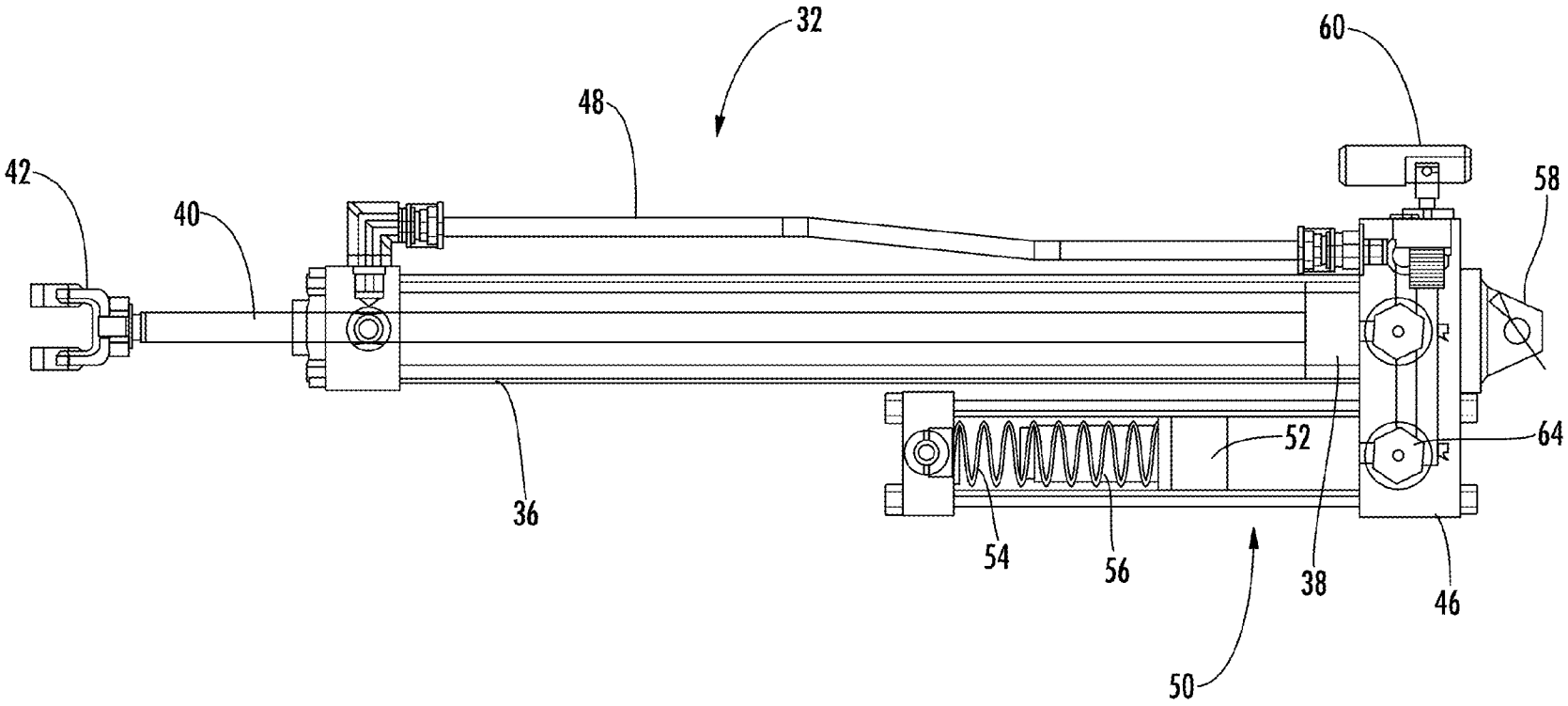
FIG. 3 is a diagrammatic representation of the cylinder unit of FIG. 2 showing certain internal details.

Referring now to FIGS. 2 and 3, certain additional details of cylinder unit 32 can be most easily explained. As shown, cylinder unit 32 includes a main cylinder 36 in which a slidable piston 38 (FIG. 3) is located. A rod 40, attached to one side of piston 38, extends out an end of main cylinder 36. The distal end of rod 40 carries a bracket 42 for pivotal connection to support structure 24. An expansible boot 44 may be located around the part of rod 40 outside of main cylinder 36 to inhibit ingress of environmental contaminants. In this example, piston 38 can reciprocate through a stroke of eighteen inches.

A manifold structure 46 is located at the other end of main cylinder 36. As explained more fully below, manifold structure 46 routes hydraulic fluid in a closed loop between first and second sides of piston 38. In his regard, an external hose 48 extends between manifold structure 46 and the opposite end of main cylinder 36 for passage of hydraulic fluid across sides of piston 38. In this exemplary embodiment, hose 48 may be a rigid hose formed of stainless steel or other suitable material.

In addition, some hydraulic fluid can pass to and from an accumulator 50 fixed to manifold structure 46. Accumulator 50 includes a floating piston 52 which reciprocates toward and away from a spring 54. In this case, spring 54 is configured as a coil spring located around (coaxially with) a "stop tube" 56 located on the back side of piston 52. Stop tube 56 serves to limit the linear travel of piston 52 as spring 54 is compressed. A bracket 58 is located on the backside of manifold structure 46 for pivotal attachment of cylinder unit 32 to attachment structure 34.

Figure 5:
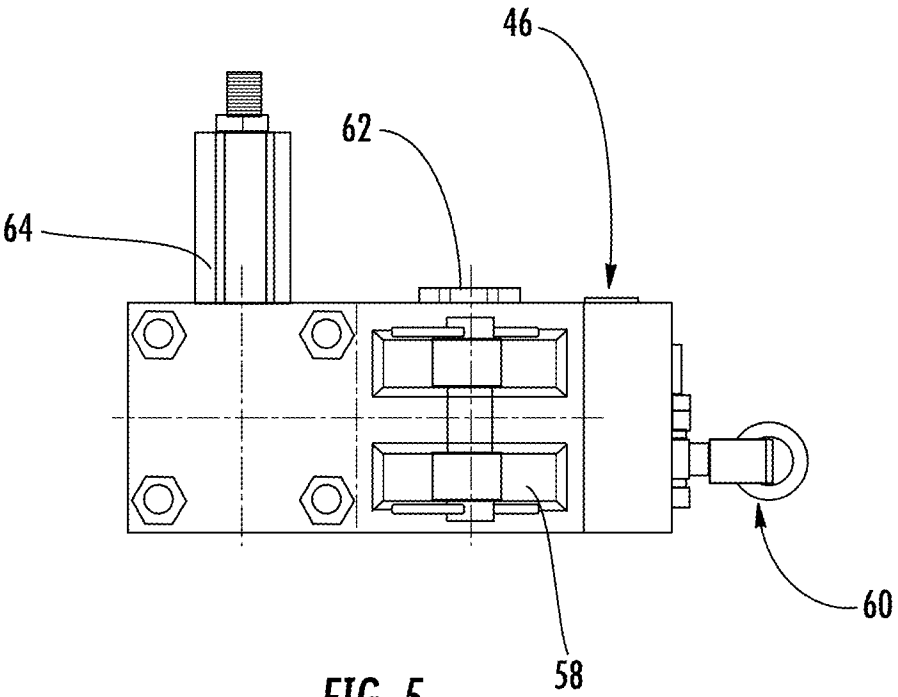
FIG. 5 is an end view of the cylinder unit of FIG. 2.
Figure 4:
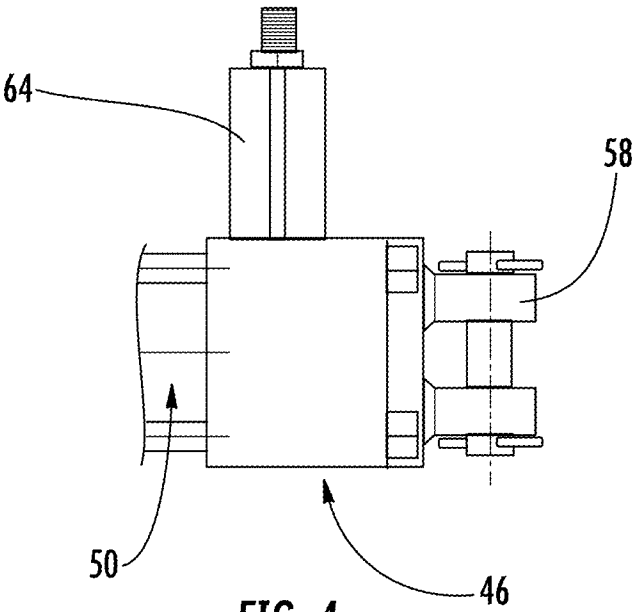
FIG. 4 is an enlarged elevation of a manifold portion of the cylinder unit of FIG. 2.

Referring now also to FIGS. 4 and 5, manifold structure 46 includes a manual pull valve 60 that allows flow of hydraulic fluid from the rod side to the opposite side of piston 38 when it is desired to move gangway 10 into the stowed position. It is contemplated that any suitable mechanism may be provided to effect pulling of valve 60 into the open position. For example, some preferred embodiments could utilize a lever, similar to those used for bicycle brakes, mounted at a convenient location on platform 12. Squeezing the lever could pull a cable connected to valve 60 so as to open it. An operator can then raise gangway 10 to its stowed position, forcing fluid from the rod side to the opposite side of piston 38. When the lever is released, valve 60 returns to its normally closed position such as via an internal spring.

An internal check valve 62 allows flow to the rod side of piston 38 from the other side when gangway 10 is lowered (after the pressure exceeds the threshold to open check valve 62). The volume occupied within main cylinder 36 by rod 40 reduces the amount of space available for hydraulic fluid flowing to the rod side of piston 38. Therefore, excess fluid that cannot flow to the rod side of piston 38 is diverted into accumulator 50. This excess fluid moves piston 52 against spring 54. The spring thus compresses, allowing fluid to flow (and the cylinder to retract).

Often, the storage container (e.g., trailer 22) will rise slightly as it is being unloaded. Specifically, suspension springs supporting the container may cause it to rise as the load is reduced. This slight raising of the storage container might damage position locking assembly 12 unless some allowance for it is made. In this regard, manifold structure 46 includes a relief valve 64 which bypasses unlock valve 60 at a threshold pressure level that might be caused by some loading or impact event (e.g., storage container movement). Preferably, the threshold pressure level at which such bypass occurs can be adjusted in the field to account for installation variables. For example, in the illustrated embodiment, the pressure threshold can be adjusted between about 100 psi and 3000 psi.

Figure 6:
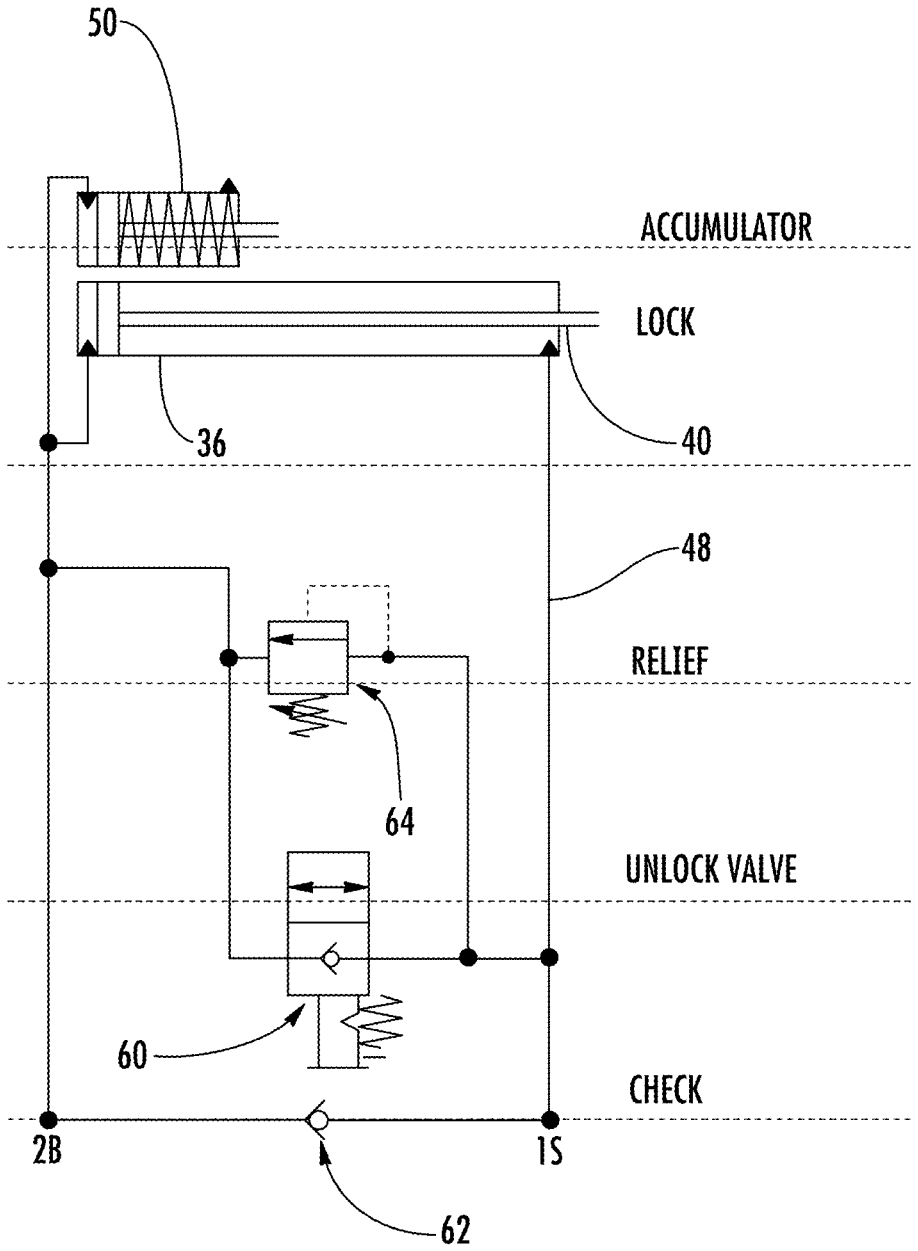
FIG. 6 is a schematic hydraulic circuit diagram of the cylinder unit of FIG. 2.

FIG. 6 is a schematic circuit diagram of cylinder unit 32 in accordance with a preferred embodiment. The operation of the circuit will be apparent to one skilled in the art based on the schematic and the above description. Briefly, however, functions of the components shown in FIG. 6 can be summarized as follows:

Lock—Moving mechanism comprising a piston coupled to a rod.

Accumulator—Accumulator takes up the fluid volume differential between the rod side and the non-rod side of the lock.

Relief (e.g., adjustable relief valve)—When pressure on the rod side of the accumulator exceeds set point threshold, relief opens to allow fluid to flow from 1S to 2B. Remains open until pressure drops below set point allowing spring to force the relief closed.

Unlock Valve—Manually actuated by pulling stem in this embodiment. When not pulled, fluid flow is blocked between 1S and 2B. When pulled, fluid can freely flow between 1S and 2B.

Check—Allows fluid to flow from 2B to 1S anytime pressure at 2B is sufficient to open the check valve. In a preferred embodiment, the check valve requires pressure at 2B of at least 10 psi greater than the pressure at 1S.

Those skilled in the art should appreciate that the above description provides a gangway having a novel position locking assembly. While one or more preferred embodiments of the invention have been described above, it should be understood that any and all equivalent realizations of the present invention are included within the scope and spirit thereof. The embodiments depicted are presented by way of example only and are not intended as limitations upon the present invention. Moreover, it should be understood by those skilled in the art that the present invention is not limited to these embodiments since modifications can be made. Therefore, it is contemplated that any and all such embodiments are included in the present invention as may fall within the scope and spirit thereof.

What is claimed is:

1. A gangway comprising:

a fixed platform;

a support structure connected to the fixed platform in a manner that allows the support structure to rotate with respect to the fixed platform; and a releasable position locking assembly that, when locked, inhibits rotation of said support structure in a raising direction while allowing rotation of said support structure in a lowering direction, said releasable locking assembly including a closed-loop fluid arrangement.

2. The gangway of claim 1, wherein said closed loop fluid arrangement comprises:

a cylinder in which a piston reciprocates; and fluid handling components including an unlock valve, said fluid handling components configured to allow transfer of fluid from a first side of said piston to a second side of said piston as said support structure is lowered into a working position, said fluid handling components not allowing transfer of said fluid from said second side of said piston back to said first side of said piston for raising of said support structure unless said unlock valve is opened.

3. The gangway of claim 2, wherein said cylinder and said fluid handling components are integrated into a cylinder unit connected between said support structure and a fixed attachment structure.

4. The gangway of claim 2, wherein said fluid handling components include a check valve through which fluid transfers from said first side of said piston to said second side of said piston.

5. The gangway of claim 2, wherein said unlock valve comprises a manual pull valve.

6. The gangway of claim 2, wherein said fluid handling components further comprise an accumulator for receiving excess fluid due to volume occupied by a piston rod of the piston.

7. The gangway of claim 6, wherein said accumulator comprises a free piston movable against a spring.

8. The gangway of claim 2, wherein said fluid handling components further comprise a relief valve configured to also allow transfer of fluid from said second side of said piston back to said first side of said piston when a predetermined threshold pressure is encountered.

9. The gangway of claim 8, wherein said relief valve is adjustable so that said predetermined threshold pressure can be varied.

10. A gangway comprising:

a fixed platform;

a support structure connected to the fixed platform in a manner that allows the support structure to rotate with respect to the fixed platform; and a releasable position locking assembly that inhibits rotation of said support structure in a raising direction, said releasable locking assembly including a closed-loop fluid arrangement, wherein said closed loop fluid arrangement comprises:

a cylinder in which a piston reciprocates;

fluid handling components including an unlock valve, said fluid handling components configured to allow transfer of fluid from a first side of said piston to a second side of said piston as said support structure is lowered into a working position, said fluid handling components not allowing transfer of said fluid from said second side of said piston back to said first side of said piston for raising of said support structure unless said unlock valve is opened; and said fluid handling components further including an accumulator for receiving excess fluid due to volume occupied by a piston rod of the piston, said accumulator having a free piston movable against a spring, wherein said free piston carries a stop feature to limit its axial movement against said spring.

11. The gangway of claim 10, wherein said spring comprises a coil spring and said stop feature is configured as a stop tube coaxial with said coil spring.

12. A gangway comprising:

a support structure having a proximal end and a distal end, the proximal end of the support structure being pivotally connected to a platform;

a cage assembly pivotally connected to the distal end of the support structure; and a releasable position locking assembly that, when locked, inhibits rotation of said support structure in a raising direction while allowing rotation of said support structure in a lowering direction, said releasable locking assembly including:

a cylinder in which a piston reciprocates; and fluid handling components including an unlock valve that when opened allows flow of fluid to a first side of said piston for raising of said support structure.

13. The gangway of claim 12, wherein said cylinder and said fluid handling components are integrated into a cylinder unit connected between said support structure and a fixed attachment structure.

14. The gangway of claim 12, wherein said fluid handling components include a check valve through which fluid transfers from the first side of said piston to a second side of said piston.

15. The gangway of claim 12, wherein said unlock valve comprises a manual pull valve.

16. The gangway of claim 12, wherein said fluid handling components further comprise a relief valve configured to allow transfer of fluid from a second side of said piston back to the first side of said piston when a predetermined threshold pressure is encountered.

17. The gangway of claim 16, wherein said fluid handling components further comprise an accumulator for receiving excess fluid due to volume occupied by a piston rod of the piston.

18. The gangway of claim 17, wherein said accumulator comprises a free piston movable against a spring.

19. The gangway of claim 18, wherein said free piston carries a stop feature to limit its axial movement against said spring.

20. A gangway comprising:

a support structure having a proximal end and a distal end, the proximal end of the support structure being pivotally connected to a platform;

a cage assembly pivotally connected to the distal end of the support structure; and a releasable position locking assembly that inhibits rotation of said support structure in a raising direction, said releasable locking assembly including:

a cylinder in which a piston reciprocates; and fluid handling components including an unlock valve that when opened allows flow of fluid to a first side of said piston for raising of said support structure, said fluid handling components further including a relief valve configured to allow transfer of fluid from a second side of said piston back to the first side of said piston when a predetermined threshold pressure is encountered and an accumulator for receiving excess fluid due to volume occupied by a piston rod of the piston, said accumulator having a free piston movable against a spring, said free piston carrying a stop feature to limit its axial movement against said spring.

* * * * *